US007884683B2

(12) United States Patent
Ahlers

(10) Patent No.: US 7,884,683 B2
(45) Date of Patent: Feb. 8, 2011

(54) DIRECTIONAL COUPLER IN COAXIAL LINE TECHNOLOGY

(75) Inventor: Roland Ahlers, Hoehenkirchen/Siegertsbrunn (DE)

(73) Assignee: Rohde & Schwarz GmbH & Co., KG, Munich (DE)

( * ) Notice: Subject to any disclaimer, the term of this patent is extended or adjusted under 35 U.S.C. 154(b) by 637 days.

(21) Appl. No.: 10/595,763

(22) PCT Filed: Oct. 27, 2004

(86) PCT No.: PCT/EP2004/012146

§ 371 (c)(1),
(2), (4) Date: Sep. 25, 2008

(87) PCT Pub. No.: WO2005/048396

PCT Pub. Date: May 26, 2005

(65) Prior Publication Data

US 2009/0033436 A1 Feb. 5, 2009

(30) Foreign Application Priority Data

Nov. 12, 2003 (DE) ..... 103 52 784

(51) Int. Cl.
*H03H 7/38* (2006.01)
*H01P 3/06* (2006.01)

(52) U.S. Cl. ..... 333/112; 333/123

(58) Field of Classification Search ..... 333/109, 333/110, 111, 112, 115, 116, 123
See application file for complete search history.

(56) References Cited

U.S. PATENT DOCUMENTS 3,243,704 A * 3/1966 Adams et al. ..... 324/95
3,654,570 A 4/1972 Thomas
5,148,132 A 9/1992 Chapell
5,347,244 A 9/1994 Monti
7,095,294 B2 * 8/2006 Fojas ..... 333/112

FOREIGN PATENT DOCUMENTS

DE 2350186 4/1975
DE 4017412 A1 1/1991

OTHER PUBLICATIONS

International Preliminary Report on Patentability and International Search Report, PCT/EP2004/012146, May 12, 2006, 8 pages.

* cited by examiner

*Primary Examiner*—Dean O Takaoka
(74) *Attorney, Agent, or Firm*—Lewis, Rice & Fingersh, L.C.

(57) ABSTRACT

A directional coupler comprising a first connection for the inlet or outlet of a shaft, a first decoupling connection which is used to decouple a coupled shaft, a second connection for the inlet or outlet of the inlet or outlet shaft from the first connection and a second decoupling connection which is used to decouple the coupled shaft. The first connection and the first decoupling connection are connected to the internal conductor and to the external conductor of a coaxial conductor on the first connection surface thereof, by means of a first network. The second connection and the second decoupling connection are connected to the internal conductor and to the external conductor of the coaxial conductor on the second connection surface thereof, by means of a second network. The coaxial conductor is curved in such a manner that it is arranged in a parallel manner in relation to the first and second connection surfaces thereof, with a planar circuit board containing the first connection, the second connection, the first decoupling connection and/or second decoupling connection.

8 Claims, 3 Drawing Sheets

DIRECTIONAL COUPLER IN COAXIAL LINE TECHNOLOGY

CROSS REFERENCE TO RELATED APPLICATIONS

This application is a §371 National Phase of PCT/EP2004/012146 filed Oct. 27, 2004 and claims priority to German Patent Application Serial No.: DE10352784.2 filed Nov. 12, 2003.

BACKGROUND

1. Field of the Invention

The invention relates to a directional coupler in coaxial line technology.

2. Description of the Related Art

Directional couplers are used in high frequency technology for separate measurement of a go-and-return wave in a line. In the end stages of amplifiers, directional couplers are used for example to measure the voltage standing wave ratio. A directional coupler is hereby used selectively in coaxial line technology.

A directional coupler of this type in coaxial line technology is described for example in U.S. Pat. No. 5,926,076. The directional coupler hereby comprises a coaxial line with an inner conductor, a hollow-cylindrical dielectric guided around the inner conductor and a hollow-cylindrical outer conductor which is applied on the casing of the hollow-cylindrical dielectric and a printed circuit board on which the two decoupling units of the directional coupler are essentially applied. Coaxial line and printed circuit board with decoupling units are disposed at an adjustable spacing relative to each other in a housing.

The comparatively high complexity with respect to a mechanical and also electrical connection between the coaxial line and the two decoupling units and the connections thereof via a common spacing, attachment and mounting in a common housing is disadvantageous in this arrangement. Also the specific and efficient discharge of heat produced from the directional coupler circuit by means of resistors and heat discharge bars has a comparatively complex configuration.

SUMMARY

The object therefore underlying the invention is to produce a directional coupler in coaxial line technology in which the mechanical and also electrical connection between the coaxial line and the connections of the directional coupler, in particular the decoupling connections, is produced with minimal additional complexity with respect to the technical appliance.

The object of the invention is achieved by a directional coupler in coaxial line technology having the features of claim 1.

The electrical connection between the inner and outer conductor of the coaxial line and the individual connections of the directional coupler is effected at the input and output of the coaxial line via one resistance network respectively.

The mechanical connection between the coaxial line and the individual connections of the directional coupler which are positioned on a planar printed circuit board is produced in that the coaxial line has for example a semicircular or U-shaped bent configuration and hence is aligned parallel to the planar printed circuit board with its two connection faces and hence, via connection lines or resistors which are part of the above-mentioned resistance networks, a comparatively simple mechanical connection between the inner and outer conductor of the coaxial line and the connections of the directional coupler is achieved.

An electrical and mechanical connection produced in this manner between a coaxial line and the connections of a directional coupler represents a minimum cost solution with respect to material and manufacturing complexity.

Advantageous embodiments of the invention are indicated in the dependent claims.

The planar printed circuit board can be configured in SMD technology. In particular the arrangement of the resistors of both resistance networks, which lead the screening and hence the outer conductor of the coaxial line at both ends to earth potential, are absolutely crucial for the characteristic of the directional coupler and can thus be disposed in a relatively flexible manner.

By fitting the coaxial line with ferrites, a usable characteristic of the directional coupler is achieved over several octaves.

BRIEF DESCRIPTION OF THE DRAWINGS

The embodiment of the invention is represented in the drawing and is described subsequently in more detail. There are shown.

DETAILED DESCRIPTION OF THE PREFERRED EMBODIMENT(S)

The directional coupler according to the invention in coaxial line technology is described in its embodiment subsequently with reference to FIG. 1 to FIG. 3.

Figure 1:
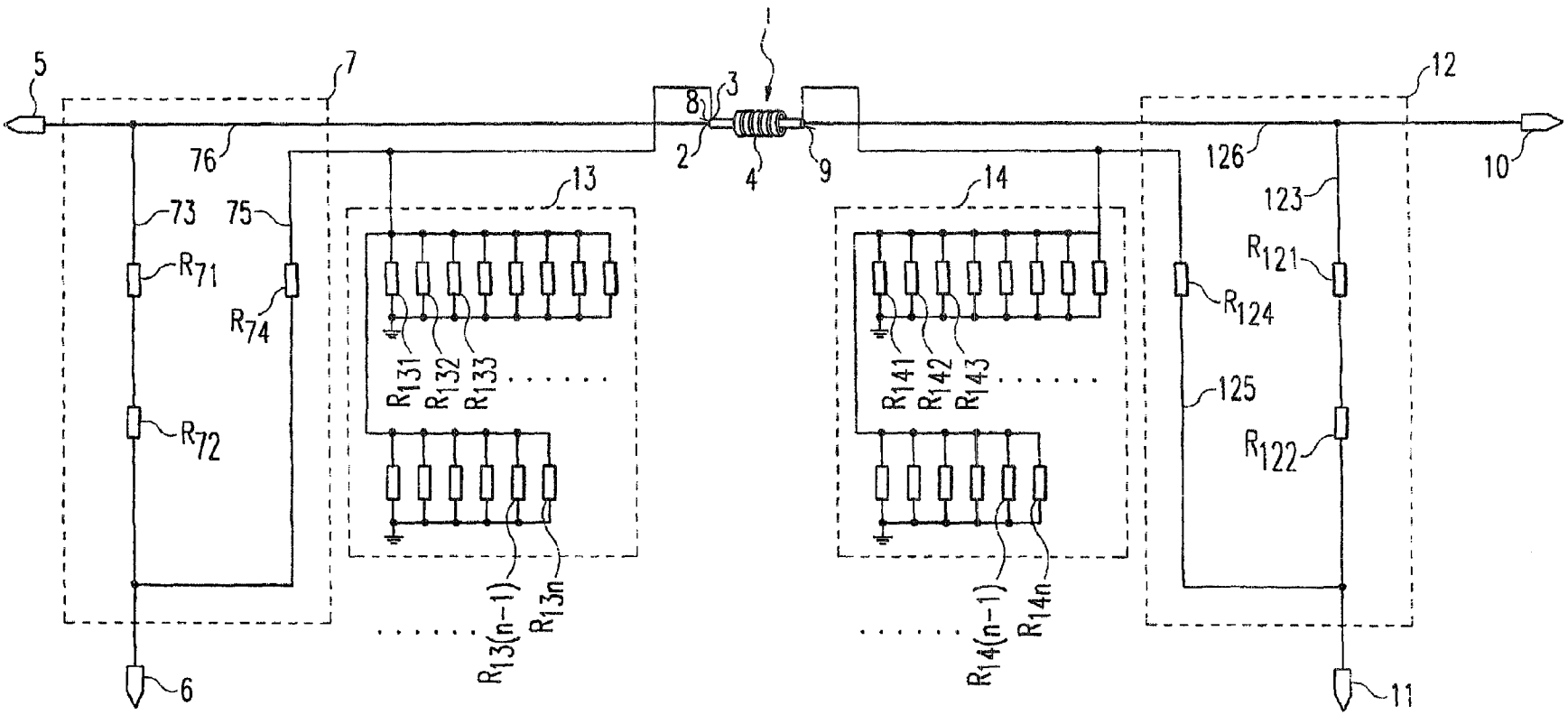
FIG. 1 a circuit diagram of a directional coupler according to the invention in coaxial line technology.

The directional coupler according to the invention in coaxial line technology comprises according to FIG. 1 essentially a coaxial line 1 which comprises an inner conductor 2 and an outer conductor 3 separated via a dielectric. The coaxial line 1 is surrounded on its outer casing by a plurality of aligned ferrite core rings 4.

The coaxial line 1 is connected at its first connection face 8 to the first connection 5 and to the first decoupling connection 6 of the directional coupler via a first resistance network 7 and, at its second connection face 9, to the second connection 10 and to the second decoupling connection 11 via a second resistance network 12 which is symmetrical to the first resistance network 7.

The first resistance network 7 comprises a series connection of a resistor $R_{71}$ and $R_{72}$ in the connection line 73 between the first connection 5 and the first decoupling connection 6 and a resistor $R_{74}$ in the connection line 75 between the outer conductor 3 of the coaxial line 1 and the first decoupling connection 6 and also a direct connection line 76 between the inner conductor 2 of the coaxial line 1 and the first connection 5.

The second resistance network 12 comprises, symmetrically to the first resistance network 7, a series connection of a resistor $R_{121}$ and $R_{122}$ in the connection line 123 between the second connection 10 and the second decoupling connection 11 and a resistor $R_{124}$ in the connection line 125 between the outer conductor 3 of the coaxial line 1 and the second decoupling connection 11 and also a direct connection line 126 between the inner conductor 2 of the coaxial line 1 and the second connection 10.

The outer conductor 3 is led at the first connection face 8 of the coaxial line 1 by a third resistance network 13 to earth potential. The third resistance network 13 comprises a parallel connection of a plurality of low impedance resistors $R_{131}$, $R_{132}$, $R_{133}$, . . . , $R_{13(n-1)}$, $R_{13n}$.

The outer conductor 3 at the second connection face 9 of the coaxial line 1 is led to earth potential by a fourth resistance network 14, which is configured completely symmetrically to the third resistance network 13. The fourth resistance network 14 accordingly comprises a parallel connection of a plurality of low impedance resistors $R_{141}$, $R_{142}$, $R_{143}$, . . . , $R_{14(n-1)}$, $R_{14n}$.

The resistors $R_{71}$, $R_{72}$ and $R_{74}$ of the first resistance network 7 and the resistors $R_{121}$, $R_{122}$, $R_{124}$ of the second resistance network 12 have a higher impedance design than the low impedance resistors $R_{131}$, . . . , $R_{13n}$ of the third resistance network 13 and the low impedance resistors $R_{141}$, . . . , $R_{14n}$ of the fourth resistance network 14.

Figure 2:
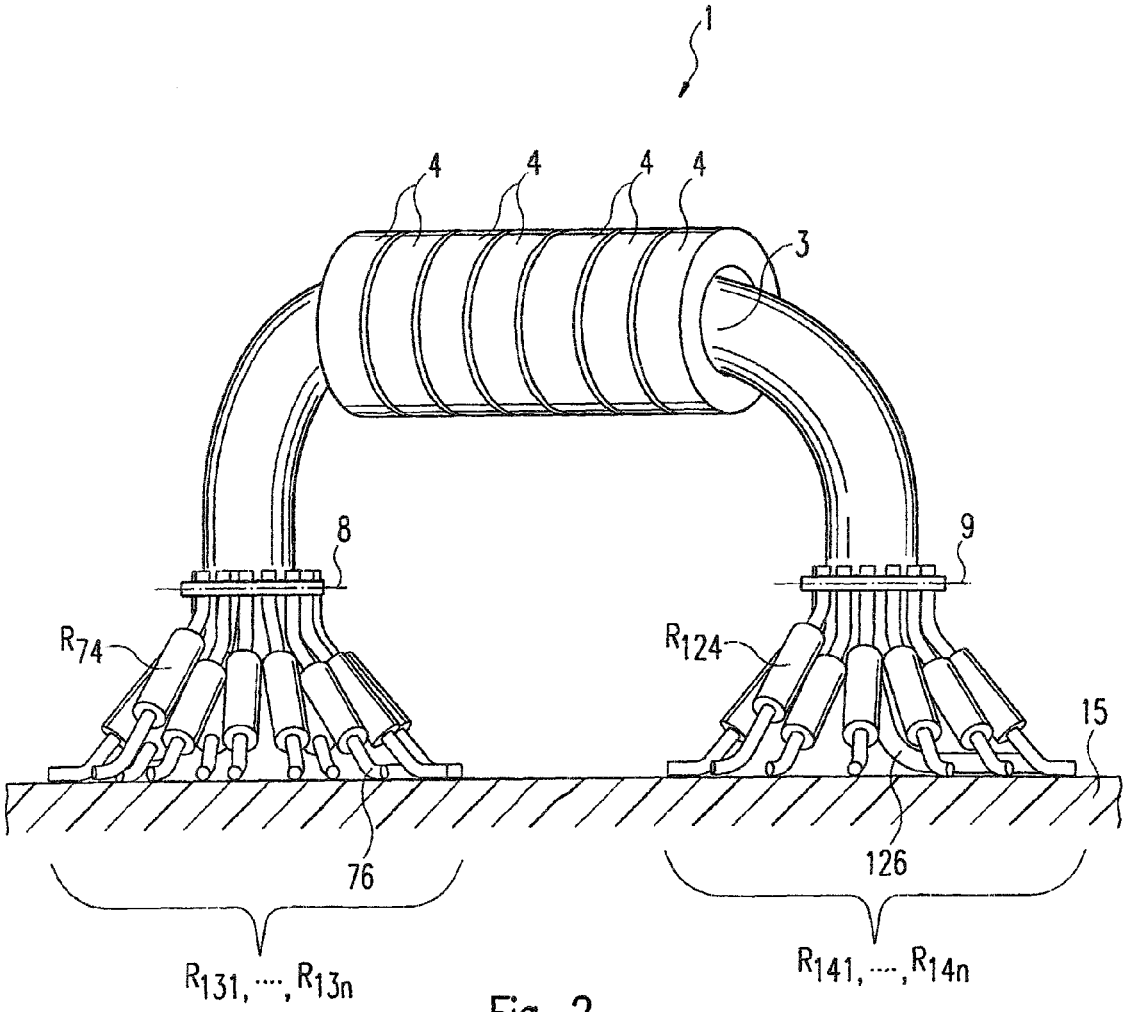
FIG. 2 a side view of a directional coupler according to the invention in coaxial line technology and FIG. 3 a plan view of a directional coupler according to the invention in coaxial line technology.
Figure 3:
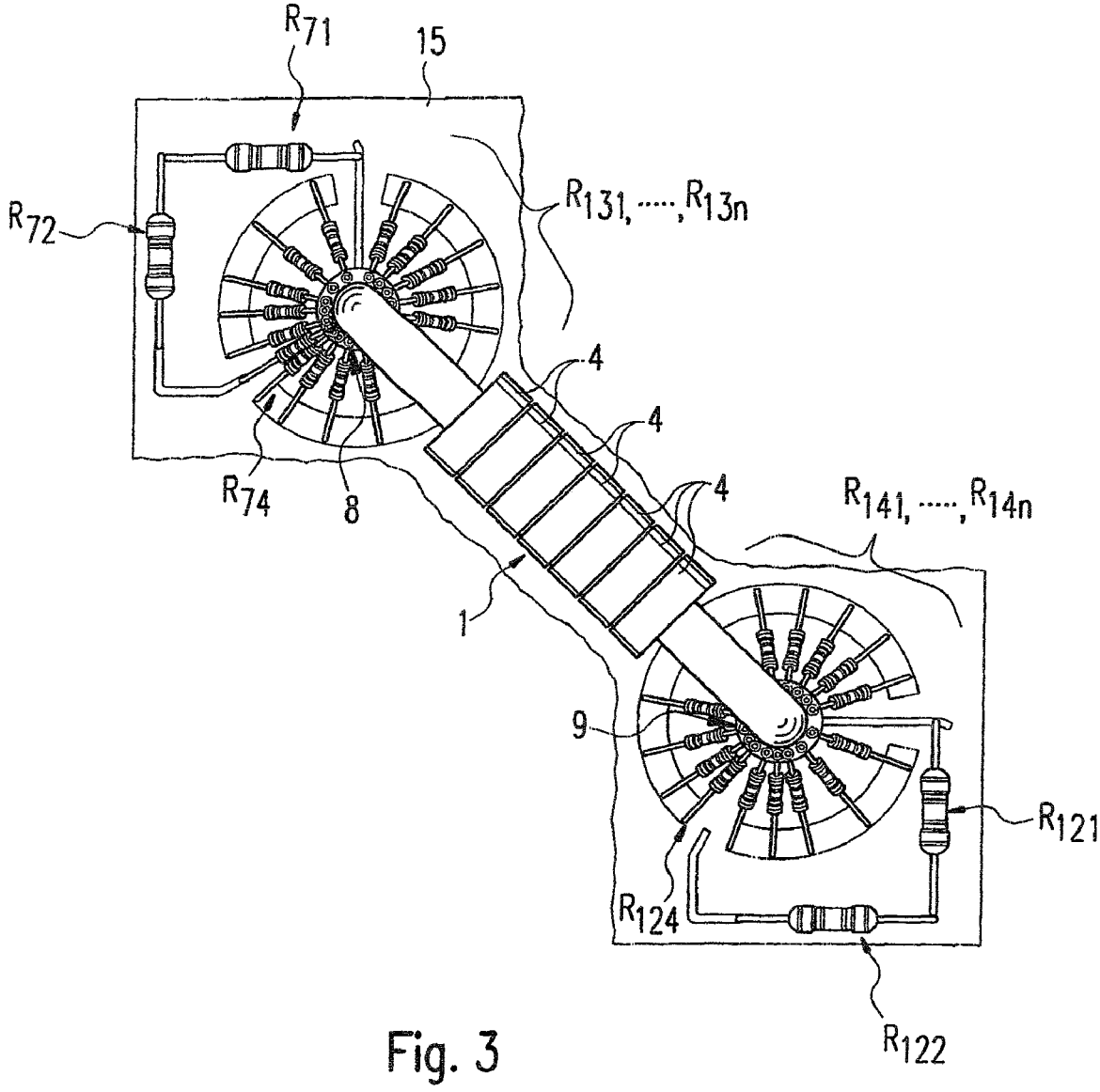

In side view in FIG. 2 and in plan view in FIG. 3 of the directional coupler according to the invention in coaxial line technology, the semicircular or U-shaped configuration of the coaxial line 1 can be detected. Bending of the originally linear coaxial line 1 into the circular or U-shaped configuration according to FIG. 2 or FIG. 3 is possible by using the semi-rigid technology in the inner conductor 2, dielectric and outer conductor 3 of the coaxial line 1.

In FIG. 2 or FIG. 3, likewise the conical arrangement of the resistors $R_{131}$, . . . , $R_{13n}$ of the third resistance network 13 or of the resistors $R_{141}$, . . . , $R_{14n}$ of the fourth resistance network 14 between the outer conductor 3 of the coaxial line 1 and the planar printed circuit board 15 can be detected, which contains the first and second connection 5 and 10 or the first and second decoupling connection 6 and 11, further components which are disposed for example in SMD technology. All the resistors $R_{131}$, . . . , $R_{13n}$ and also $R_{141}$, . . . , $R_{14n}$ are, as is evident in FIG. 2 or FIG. 3, soldered onto the printed circuit board.

In FIG. 2, finally also the connection line 76 or 126 from the inner conductor 2 of the coaxial line to the first connection 5 or to the second connection 10 of the directional coupler and also the resistor $R_{74}$ of the first resistance network 7 or the resistor $R_{124}$ of the second resistance network 12, which are likewise configured in conventional technology and are both aligned in the conical arrangement of the resistors $R_{131}$, . . . , $R_{13n}$ of the third resistance network 13 or of the resistors $R_{141}$ . . . $R_{14n}$ of the fourth resistance network 14, can be detected.

In the plan view in FIG. 3, finally the resistors $R_{71}$ and $R_{72}$ of the first resistance network 7 and the resistors $R_{121}$ and $R_{122}$ of the second resistance network 12 can be detected, which are also configured in conventional technology and soldered on the planar printed circuit board 15 which is produced in the embodiment in SMD technology.

The topology of the first, second, third and fourth resistance network 7, 12, 13 and 14, the suitable parameterisation of the associated resistors $R_{71}$, $R_{72}$, $R_{74}$, $R_{121}$, $R_{122}$, $R_{124}$ and $R_{133}$, . . . , $R_{13n}$ and also $R_{141}$, . . . , $R_{14n}$ and the spatial arrangement in particular of the resistors $R_{74}$, $R_{124}$, $R_{131}$, . . . , $R_{13n}$ and $R_{141}$, . . . , $R_{14n}$ establish the directional sharpness and coupling attenuation of the directional coupler. By suitable choice of topology, parameterisation and spatial arrangement of the resistors, it can be ensured that, at the first decoupling connection 6, a constructive positive superimposition is decoupled from the go-and-return waves between the first connection 5 and first connection face 8 of the coaxial line 1 and, at the second decoupling connection 11, a mutual obliteration of the two waves, which are decoupled from the go-and-return waves between the second connection 10 and second connection face 9 of the coaxial line 1, is achieved.

In this way, a broadband directional coupler can be produced without great complexity for applications in particular with broadband amplifiers, for example between 30 and 500 MHz.

The invention is not restricted to the represented embodiment. The described elements can be combined with each other in any manner within the scope of the invention.

The invention claimed is:

1. A directional coupler comprising:

a first connection to input or output a wave and a first decoupling connection to decouple a coupled wave, both of said first connection and said first decoupling connection being connected via a first resistance network to an inner conductor and an outer conductor of a coaxial line at a first connection face; and a second connection to input or output said input or output wave from said first connection and a second decoupling connection to decouple a coupled wave, both of said second connection and said second decoupling connection connected via a second resistance network to said inner conductor and to said outer conductor of said coaxial line at a second connection face;

wherein, said coaxial line is bent in such a manner that said first connection face and said second connection face are aligned generally parallel to a generally planar printed circuit board; said circuit board including at least one of said first connection, said second connection, said first decoupling connection, or second decoupling connection;

wherein, said outer conductor of said coaxial line is led to earth potential at said first connection face via a third resistance network and at said second connection face by a fourth resistance network; and wherein, resistors forming said first, second, third and fourth resistance networks are components soldered onto said circuit board in SMD technology.

2. The directional coupler of claim 1 wherein both of said third and said fourth networks are low impedance networks.

3. The directional coupler of claim 1 wherein said coaxial line is bent in a semicircular shape.

4. The directional coupler of claim 3 wherein:

said coaxial line is mechanically and electrically connected to said circuit board at said first connection face via a first connection conductor connected to said inner conductor and via first conically disposed resistors connected to said outer conductor, said first connection conductor and said first conically disposed resistors being a part of said first network or said third network; and said coaxial line is mechanically and electrically connected to said circuit board at said second connection face via a second connection conductor connected to said inner conductor and via second conically disposed resistors connected to said outer conductor, said second connection conductor and said second conically disposed resistors being a part of said second network or said fourth network.

5. The directional coupler of claim 1 wherein said coaxial line is bent in a U-shape.

6. The directional coupler of claim 5 wherein:

said coaxial line is mechanically and electrically connected to said circuit board at said first connection face via a first connection conductor connected to said inner conductor and via first conically disposed resistors connected to said outer conductor, said first connection conductor and said first conically disposed resistors being a part of said first network or said third network; and said coaxial line is mechanically and electrically connected to said circuit board at said second connection face via a second connection conductor connected to said inner conductor and via second conically disposed resistors connected to said outer conductor, said second connection conductor and said second conically disposed resistors being a part of said second network or said fourth network.

7. The directional coupler of claim 1 further comprising at least one ferrite ring made of a ferrite material which surrounds said coaxial line.

8. The directional coupler of claim 7 wherein said at least one ferrite ring comprises a plurality of aligned ferrite rings encasing said coaxial line.

* * * * *